United States Patent [19]

Chin

[11] Patent Number: 5,007,999

[45] **Date of Patent: * Apr. 16, 1991**

[54] METHOD FOR REDUCING SULFUR OXIDE EMISSION DURING AN FCC OPERATION

[75] Inventor: Arthur A. Chin, Cherry Hill, N.J.

[73] Assignee: Mobil Oil Corp., Fairfax, Va.

[ * ] Notice: The portion of the term of this patent subsequent to Jan. 22, 2008 has been disclaimed.

[21] Appl. No.: 337,680

[22] Filed: Apr. 13, 1989

[51] Int. Cl.[5] ..... C10G 11/18

[52] U.S. Cl. ..... 208/113; 208/52 CT; 208/149; 208/164; 502/41; 423/244

[58] Field of Search ..... 208/52 CT, 113, 164, 208/149; 502/34, 41, 42, 43; 423/244

[56] References Cited

U.S. PATENT DOCUMENTS

| | | | |
|---|---|---|---|
| 2,129,693 | 8/1935 | Houdry | 208/119 |
| 4,268,416 | 5/1981 | Stine et al. | 208/52 CT |
| 4,280,895 | 7/1981 | Stuntz et al. | 208/113 |
| 4,404,089 | 9/1983 | Zrincak | 208/120 |
| 4,409,093 | 10/1983 | Bearden et al. | 208/108 |
| 4,432,864 | 2/1984 | Myers et al. | 208/120 |
| 4,504,379 | 3/1985 | Stuntz et al. | 208/113 |
| 4,504,380 | 3/1985 | Stuntz et al. | 208/113 |
| 4,522,704 | 6/1985 | Bertsch et al. | 208/113 |
| 4,541,923 | 9/1985 | Lomas et al. | 208/113 |
| 4,613,428 | 9/1986 | Edison | 208/113 |
| 4,666,584 | 5/1987 | Luckenbach et al. | 208/113 |

FOREIGN PATENT DOCUMENTS

| | | | |
|---|---|---|---|
| 729167 | 3/1966 | Canada | 208/52 CT |

OTHER PUBLICATIONS

Technology, Aug. 8, 1983, Oil & Gas Journal, "$So_x$ Transfer Catalyst Systems for FCC Need Development", E. Thomas Habib Jr., pp. 111–113.

*Primary Examiner*—Anthony McFarlane

*Attorney, Agent, or Firm*—Alexander J. McKillop; Charles J. Speciale; Dennis P. Santini

[57] ABSTRACT

A process for reducing sulfur oxides production during an FCC cracking operation comprises the steps of:

(a) passivating metal contaminants on an FCC catalyst by contacting the FCC catalyst with a sulfur-containing compound under conditions that enable association of the sulfur with the metal contaminants;

(b) cracking hydrocarbons with the passivated FCC catalyst in an FCC cracking zone;

(c) oxidatively regenerating the catalyst in a regeneration zone whereby the carbonaceous material deposited on the catalyst in step (b) is burned off and the sulfur deposited on the FCC catalyst in step (a) is converted to sulfur oxides;

(d) reacting the sulfur oxides with a sulfur oxide adsorption additive capable of adsorbing the sulfur oxides under sulfur oxide adsorbing conditions;

(e) converting the adsorbed sulfur oxides from step (d) to hydrogen sulfide by contacting the adsorbed sulfur oxides in a separate treatment vessel with a reducing gas before the regenerated FCC catalyst and sulfur oxides adsorption additive enter the cracking zone; and (f) preventing significant amounts of the hydrogen sulfide from step (e) from entering the cracking zone.

10 Claims, 1 Drawing Sheet

Fig. 1
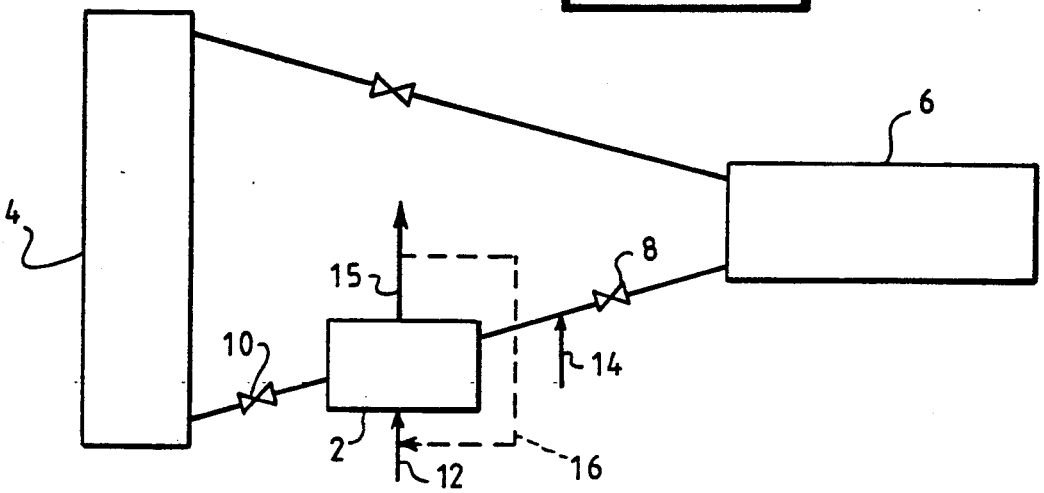
Fig. 2
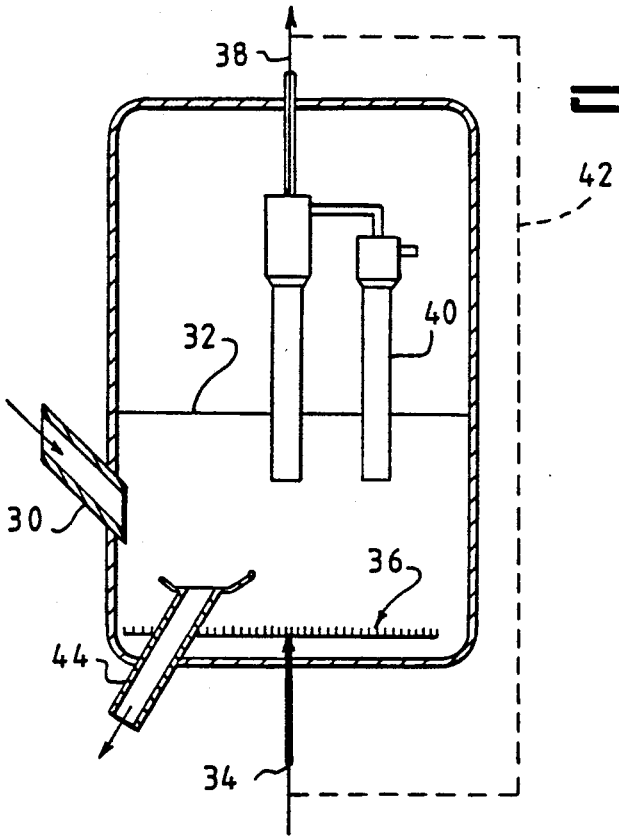
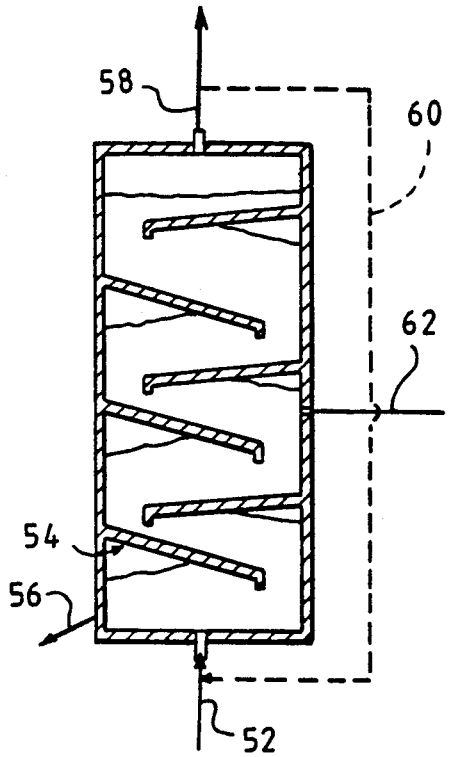
Fig. 3

METHOD FOR REDUCING SULFUR OXIDE EMISSION DURING AN FCC OPERATION

The present invention relates to an improved process for passivating metals contaminating a hydrocarbon cracking catalyst in an FCC process. More particularly, the invention relates to a more efficient way of reducing sulfur oxides emissions from an FCC process in which such metals are passivated.

BACKGROUND OF THE INVENTION

It is often desirable to convert raw hydrocarbon mixtures such as crude oil and other petroleum feedstocks to commercially valuable fuels. A number of processes for cracking hydrocarbons are known. These processes include fluid catalytic cracking (FCC) (including the FCC process of Ashland/UOP known as reduced crude conversion (RCC)), and are described in Venuto and Habib, "Fluid Catalytic Cracking with Zeolite Catalysts", Marcel Dekker, Inc., 1979 and Busch et al., "Reduced Crude Conversion—1: RCC Complex Now Cornerstone of Ashland Refinery", Oil & Gas Journal, Dec. 10, 1984.

The cracking of hydrocarbons is accomplished by contacting the hydrocarbon to be cracked with a catalyst at elevated temperatures. The catalysts most commonly used for cracking hydrocarbons comprise a crystalline aluminosilicate zeolite that has been incorporated into a matrix. These zeolites are well known and have been described, for example, in U.S. Pat. Nos. 4,432,890, 4,707,461 and 4,465,779.

The matrix into which the zeolite is incorporated may be natural or synthetic and, typically, has substantially less and, in some cases, no catalytic activity relative to the zeolite component. Some known matrices include clays, silica, metal oxides such as alumina and mixtures thereof.

A major difficulty with cracking catalysts is their tendency to become poisoned following contact with certain metal contaminants present in the hydrocarbon feedstock. The deleterious metals include vanadium, nickel, iron and copper. These metals may be present in the hydrocarbon as free metals or as components of inorganic and organic compounds such as porphyrins and asphaltenes. Poisoning leads to loss in selectivity, which causes decreased gasoline yield and increased amounts of undesirable products such as coke and light gases, i.e., hydrogen, methane and ethane. The deleterious effect of metals on cracking catalysts has been discussed, for example, in U.S. Pat. Nos. 4,376,696, 4,513,093, and 4,515,900.

Methods for counteracting the deleterious effects of metals have been developed. For example, it is known to treat FCC catalysts containing such metal contaminants with certain passivating gases. The known passivating gases may, for example, be reducing gases or sulfur-containing gases.

Reducing gases used in the past for passivating metals on an FCC cracking catalyst include hydrogen, carbon monoxide, and hydrocarbons. Sources of these reducing gases include, for example, hydrogen streams, cat cracker tail-gas, catalytic reformer tail-gas, spent hydrogen streams from catalytic hydroprocessing, synthesis gas, steam cracker gas, flue gas and mixtures thereof. The reducing gas may be contacted with the catalyst in the reaction zone or in a separate passivation zone. Separate passivation zones for contacting cracking catalysts and reducing gases are disclosed in U.S. Pat. Nos. 4,504,379, 4,504,380, 4,409,093, 4280,895 and 4,522,704.

Sulfur-containing gases used in the past for passivating metals on cracking catalysts include hydrogen sulfide, organic sulfides, such as methyl or ethyl sulfide, and mercaptans (see U.S. Pat. No. 2,129,693 at page 2, column 1, line 26, et seq). U.S. Pat. No. 4,541,923 discloses that hydrogen sulfide may accompany the lift gas in an FCC process (see column 6, line 7, et seq). Passivating metals with hydrogen sulfide in water is disclosed at column 5, line 17, et seq. of U.S. Pat. No. 4,432,864.

The passivation of metals with sulfur-containing compounds leads to the depositing of sulfur residues on the catalyst, possibly in the form of metal sulfides or oxysulfides. After the catalyst becomes deactivated during the cracking cycle, it passes to the regenerator where the carbon in coke is combusted to carbon monoxide and carbon dioxide and the sulfur components are combusted to sulfur oxides, such as $SO_2$ and $SO_3$. The emission of such sulfur oxides from an FCC unit increases with the amount of passivation by sulfur-containing compounds. It is desirable to reduce emissions of such sulfur oxides for environmental reasons.

A method for reducing emissions of sulfur oxides from catalytic cracking units is described in Edison, U.S. Pat. No. 4,613,428. The present invention constitutes an improvement over the sulfur oxides emission reducing method disclosed in the Edison patent.

In accordance with the present process, metals on an FCC catalyst are passivated by contacting the catalyst with sulfur-containing compounds under conditions where sulfur can chemically associate with the metal. The catalyst and the sulfur-containing compound are contacted at a temperature between 482° and 982° C., preferably 593° and 760° C., and more preferably 649° and 732° C. The contact time is preferably at least 3 seconds. The amount of the sulfur-containing compound that contacts the catalyst should be sufficient to effectively passivate the active metals present on the catalyst. For example, a molar ratio of S:Ni equivalents ($Ni+V/5$) between 0.05:1 to 5:1 is advantageous.

The sulfur-containing compound will usually be hydrogen sulfide. Other sulfur-containing compounds, usually organic sulfur-containing compounds, may also be used. These organic compounds will decompose under passivation conditions to produce hydrogen sulfide Thus, any sulfur-containing compound that so decomposes is suitable. Some examples of organic sulfur-containing compounds include lower alkyl thiols, thioethers, and disulfides. Typical examples of such compounds include thiomethane, thioethane, thiobutane, dimethylsulfide and diethylsulfide, and di-tertiary-nonyl polysulfide. Inorganic sulfur compounds such as carbon disulfide are also effective.

The source of the sulfur-containing compound is not critical, and may, for example, be another oil refining operation. The oil refining operation may, for example, in the case of hydrogen sulfide, be a sour fuel gas or a slip stream from the feed to a Claus unit, or, in the case of disulfides, a Merox extraction unit.

Next, the passivated catalyst is used to crack hydrocarbons in an FCC riser reactor. The catalyst is in the form of appropriately sized particles, such as microspheres, that are suspended in oil, vapor or gas. Following contact with the catalyst, the feedstock is catalytically cracked to lighter products. During the operation, the catalyst is deactivated by the deposition of coke and deleterious metals. Sulfur from the feedstock joins the sulfur from the passivation process as an additional source of deposits on the catalyst.

The hydrocarbon product stream is separated from the catalyst and passes to a fractionation zone, which is often referred to as the main column in an FCC unit. In the main column, the hydrocarbon is separated into desired boiling range fractions such as light gases, gasoline, light cycle oil, heavy cycle oil, and slurry oil.

The hydrocarbon feedstock that can benefit from the present invention includes any feedstock containing metal contaminants that adversely affect the product selectivity of cracking catalysts. The feedstock may, for example, be a whole crude oil, a light fraction of crude oil, a heavy fraction of crude oil, or other fractions containing heavy residua, such as co-derived oils, shale oils, and the like.

Any FCC cracking catalyst that is adversely affected by metal contaminants will benefit from being subjected to the process of the present invention. Some natural zeolites typically used in the cracking process include faujasite, mordenite and erionite. The natural zeolites may be treated so as to produce synthetic zeolites such as, for example, Zeolites X, Y, A, L, ZK-4, B, E, F, H, J, M, Q, T, W, Z, alpha, beta, ZSM-5 and omega. Additional cracking catalysts are described, for example, in Venuto and Habib, "Fluid Catalytic Cracking with Zeolite Catalysts", Marcel Dekkar, Inc., Page 30 (1979).

FCC cracking conditions are well known, and are not critical to the present invention. These conditions are varied in accordance with the nature of the feedstock, the catalyst, and the hydrocarbon products desired. For example, cracking conditions typically include temperatures in the range of about 450° C. to about 650° C. and pressures up to about 8 atm. The weight ratio of catalyst to oil is about 1:5–25:1. Typical weight hourly velocities are about 3–60.

In the next step, the catalyst is oxidatively regenerated in a regeneration zone. The regeneration of spent catalysts in a cracking operation is well known in the art, and the conditions of regeneration are not critical to the present invention. Generally, combustion is accomplished by contacting the spent catalyst with an oxygen-containing gas at elevated temperatures. The oxygen-containing gas is generally air. Typical elevated temperatures include, for example, a range from about 620° C. to about 820° C. During regeneration, the coke is oxidized to carbon monoxide and carbon dioxide while the sulfur deposits on the spent catalyst including the passivated metal-sulfur complex are converted to sulfur oxides. The sulfur oxides are principally sulfur dioxide and sulfur trioxide. Preferably, the regeneration zone is operated under conditions that lead to combustion of the sulfur deposits to sulfur trioxide.

As mentioned above, it is undesirable to emit large quantities of sulfur oxides into the environment. Therefore, methods have been developed for reducing sulfur oxides emission.

In the Edison patent, for example, a method for reducing sulfur oxides emissions was disclosed. The Edison method involves contacting the sulfur oxides with discrete particles of one or more metal-containing compounds capable of associating with sulfur oxides in the regeneration zone under conditions that lead to such association. The association between the metal-containing compounds in the discrete particles and the sulfur oxides is believed to result in the formation of metal sulfates. The association of the discrete entities and sulfur oxides in the regeneration zone is reversed in the reducing atmosphere of the cracking zone, where the discrete entities are disassociated from the sulfur oxides. The sulfur oxides released from the metal-containing discrete entities are converted to hydrogen sulfide, which is emitted from the cracking zone with the cracked hydrocarbon products in a form that is conveniently handled in a typical petroleum refinery. The metal-containing discrete particles are, therefore, regenerated to an active form in the cracking zone, and are capable of further associating with sulfur oxides when cycled back to the regeneration zone.

In order to increase the dissociation of the sulfur oxides from the metal-containing discrete entities in the cracking zone, the Edison patent discloses an improvement comprising contacting the regenerated catalyst and metal-containing discrete entities with at lease one gaseous reducing medium prior to the regenerated solid particles and discrete entities entering the cracking zone.

The metal-containing discrete entities disclosed in the Edison patent may be physically admixed with the catalyst, or may form an integral part of at least a portion of the catalyst. The size of the catalyst particles and of the metal-containing discrete entities are not critical to the Edison process. Preferably, at least about 80% by weight of the catalyst and of the metal-containing discrete entities are disclosed in the Edison patent as having diameters in the range of about 10–250 microns, and more preferably, in the range of about 20–125 microns. The discrete entities preferably have a surface area in the range of about 25 $m^2$/gm. to about 600 $m^2$/gm., more preferably about 50 $m^2$/gm. to about 400 $m^2$/gm., and still more preferably about 75 $m^2$/gm. to about 350 $m^2$/gm.

When the discrete particles form an integral part of the catalyst, the discrete particles and the catalyst may be combined by known methods including impregnating the catalyst with a salt of the desired metal, mulling the components of the discrete entity with those of the catalyst, spray-drying a slurry of mixed components, etc. Where the metal-containing discrete entities are added to the FCC unit as separate particles, they may be formed into any shape such as pills, cakes, extradites, powders, granules, spheres, etc., using known methods.

Any discrete entity capable of associating with at least one sulfur oxide, preferably sulfur trioxide, at the conditions present in the regeneration zone of an FCC unit and of dissociating from the sulfur oxide at the conditions present in the cracking zone of an FCC unit may be used in the Edison process. The discrete entities are preferably stable solids at the temperature of the regenerator and reactor. Most of the discrete entities comprise metal oxides.

Many specific metal-containing discrete entities are disclosed in the Edison patent. Among these are alumina; oxides of Group IIA metals, typified by magnesia as set forth in U.S. Pat. Nos. 3,835,031 and 3,699,037; cerium oxides as described in U.S. Pat. No. 4,001,375; and the several metal components described in U.S. Pat. No. 4,153,534 including compounds of sodium, scandium, titanium, iron, chromium, molybdenum, manganese, cobalt, nickel, antimony, copper, zinc, cadmium, rare earth metals and lead.

A preferred class of discrete entities useful in the Edison process as disclosed in the Edison patent are metal-containing spinels described in European Patent Application No. 81303336.2, Publication No. 0045170.

The metal of the spinel is preferably an alkaline earth metal. Some examples of metal-containing spinels include $MnAl_2O_4$, $FeAl_2O_4$, $CoAl_2O_4$, $NiAl_2O_4$, $MgTiMgO_4$, $FeMgFeO_4$, $FeTiFeO_4$, $ZnSnZnO_4$, $GaMgGaO_4$, $InMgInO_4$, $BeLi_2F_4$, $MoLi_2O_4$, $SnMg_2O_4$, $MgAl_2O_4$, $CuAl_2O_4$, $LiAl_5O_8$, $ZnK_2(CN)_4$, $CdK_2(CN)_4$, $HgK_2(CN)_4$, $ZnTi_2O_4$, $FeV_2O_4$, $MgCr_2O_4$, $MnCr_2O_4$, $FeCr_2O_4$, $CoCr_2O_4$, $NiCr_2O_4$, $ZnCr_2O_4$, $CdCr_2O_4$, $MnCr_2S_4$, $ZnCr_2S_4$, $CdCr_2S_4$, $TiMn_2O_4$, $MnFe_2O_4$, $FeFe_2OO_4$, $CoFe_2O_4$, $NiFe_2O_4$, $CuFe_2O_4$, $ZnFe_2O_4$, $CdFe_2O_4$, $MgCo_2O_4$, $TiCo_2O_4$, $CoCo_2O_4$, $SnCo_2O_4$, $CoCo_2S_4$, $CuCo_2S_4$, $GeNi_2O_4$, $NiNi_2S_4$, $ZnGa_2O_4$, $WAg_2O_4$, and $ZnSn_2O_4$.

The metal-containing discrete entities may also contain a metal component for promoting the oxidation of sulfur dioxide to sulfur trioxide at the conditions present in the FCC regenerating zone. Sulfur trioxide is believed to be more susceptible to association with the metal-containing discrete entity. The additional metal for oxidizing sulfur dioxide to sulfur trioxide may, for example, be a metal of group IB, IIB, IVB, VIA, VIB, VIIA, and VIII of the periodic table, the rare earth metals, vanadium, iron, tin, antimony and mixtures thereof. The amount of the additional metal in the discrete entity is small, usually ranging from about 0.05 ppm to about 1%.

Additional useful metal-containing discrete entities suitable for use in the Edison method as well as additional properties and aspects of them are contained in Edison, U.S. Pat. No. 4,613,428 at column 5, line 18 to column 10, line 32. This entire discussion is incorporated by reference in the present specification.

In the improved method of the Edison patent, the metal-containing discrete entities contact a gaseous reducing medium before the discrete entities enter the cracking zone. Edison speculates that the reducing medium increases the dissociation of sulfur oxides from the discrete entities. Any gaseous reducing medium or mixture of gaseous reducing media disclosed as being capable of enhancing the dissociation of sulfur oxides from the discrete entities in the Edison method can be used. Some examples of gaseous reducing media include hydrogen, hydrocarbons containing 1–5 carbon atoms per molecule and carbon monoxide The preferred relative amounts of catalyst and metal-containing discrete entities disclosed in the Edison patent are about 80–99 parts and about 1–20 parts by weight, respectively.

Contact between the metal-containing discrete entities and the gaseous reducing medium preferably occurs in the transfer line between the regenerating zone and the cracking zone in the Edison method. A critical aspect of the Edison method is the introduction of substantially all of the reducing gaseous medium from the transfer line to the cracking zone along with the regenerated catalyst and the discrete entities Contact between the reducing medium and the catalyst, as stated above, leads to the production of hydrogen sulfide, which also enters the cracking zone. This hydrogen sulfide exits the cracking zone along with the cracked hydrocarbon. The hydrogen sulfide may then be excluded by converting the sulfide to sulfur in conventional ways. The addition of the gaseous reducing medium in conjunction with a sulfur-containing compound for passivating the catalyst may, however, place a strain on the gas plant and sulfur removal system.

There is a need, therefore, for an improved method for reducing sulfur oxides emission from an FCC unit. In particular, there is a need for a more efficient use of sulfur-containing compounds added to an FCC operation for the purpose of passivating the metal contaminants on the cracking catalyst.

SUMMARY OF THE INVENTION

These and other objectives as will be apparent to those of ordinary skill in the art have been met by combining a method for passivating metal contaminants on an FCC catalyst by contacting the metal contaminants with a sulfur-containing compound and an improvement of the method disclosed by Edison, U.S. Pat. No. 4,613,428 for reducing sulfur oxide emissions from the regeneration zone of a hydrocarbon catalytic cracking unit. The present invention provides a process for reducing sulfur oxides production during an FCC cracking operation, comprising the steps of:

(a) passivating metal contaminants on an FCC catalyst by contacting the FCC catalyst with a sulfur-containing compound under conditions that enable association of the sulfur with the metal contaminants;

(b) cracking hydrocarbons with the passivated FCC catalyst in an FCC cracking zone;

(c) oxidatively regenerating the catalyst in a regeneration zone whereby the carbonaceous material deposited on the FCC catalyst in step (b) is burned off and the sulfur deposited on the FCC catalyst in step (a) is converted to sulfur oxides;

(d) reacting the sulfur oxides with a sulfur oxide adsorption additive capable of adsorbing the sulfur oxides under sulfur oxide adsorbing conditions;

(e) converting the adsorbed sulfur oxides from step (d) to hydrogen sulfide by contacting the adsorbed sulfur oxides in a separate treatment vessel with a reducing gas before the regenerated FCC catalyst and sulfur oxides adsorption additive enter the cracking zone; and (f) preventing significant amounts of the hydrogen sulfide from step (e) from entering the cracking zone.

DESCRIPTION OF THE DRAWINGS

FIG. 1 is a schematic drawing showing an FCC unit wherein a separate treatment vessel is integrated between a regeneration zone and a cracking zone.

FIGS. 2 and 3 illustrate possible designs for the treatment vessel.

DETAILED DESCRIPTION OF THE INVENTION

The hydrocarbon conversion process of the present invention includes the steps of passivating metal contaminants on an FCC catalyst by contacting a catalyst with a sulfur-containing compound, preferably $H_2S$; cracking hydrocarbons with the passivated catalyst in a cracking zone; regenerating the spent catalyst in a regeneration zone; contacting the resulting sulfur oxides from the regeneration zone with a sulfur oxides adsorption additive (i.e. with a metal-containing discrete entity), and converting the adsorbed sulfur oxides to hydrogen sulfide by contacting the adsorbed sulfur oxides with a reducing gas, preferably $H_2$, before the regenerated FCC catalyst and sulfur oxides adsorption additive enter the cracking zone. Part of the present invention constitutes an improvement of the method disclosed in Edison, U.S. Pat. No. 4,613,428, for reducing the level of sulfur oxides during cracking operations.

The Edison steps may be carried out in the same way in the present invention, except as noted below. These steps may also be carried out in accordance with other prior art disclosures, as would be apparent to those with ordinary skill in the art.

In the improvement of the present invention, the sulfur-oxide containing discrete entities of the Edison method, which are referred to as sulfur oxides adsorption additives in the present specification, are contacted with the reducing medium following the regeneration step in a separate treatment vessel before the sulfur oxides adsorption additive enters the cracking zone. Significant amounts of the resulting hydrogen sulfide and reducing gas are prevented from entering the cracking zone. Hydrogen sulfide exiting the separate treatment vessel is more easily disposed of than is hydrogen sulfide in the product streams exiting the reaction zone. Moreover, the hydrogen sulfide resulting from dissociation from the sulfur oxide adsorption additive can be cycled back to the separate treatment vessel under conditions that cause passivation of metals on the regenerated catalyst in the vessel.

The distinctions between the present invention and the disclosure in the Edison patent are the conversion of the adsorbed sulfur oxides to hydrogen sulfide with a reducing gas in a separate treatment vessel and the prevention of significant amounts of the reducing gas and hydrogen sulfide from entering the cracking zone. As a result of this improvement, $H_2S$ produced from sulfur oxides can be used to passivate metal contaminants on the catalyst.

Referring now to FIG. 1, a separate treatment vessel (2) is separated from cracking zone (4) and regeneration zone (6) by means of valves (8) and (10), which may conveniently be conventional slide valves. In the treatment vessel, contaminating metals on the FCC catalyst are passivated by contacting the catalyst with a sulfur-containing compound, at least part of which enters the treatment vessel through line (12). The separate vessel has the advantage of providing longer, more controllable contact times and more intimate contact between the catalyst and the sulfur-containing compound. A separate vessel further eliminates the possibility of transfer line bubbles that are rich in the sulfur-containing compound. Such bubbles tend to limit the catalyst circulation rate, and may cause corrosion of the FCC hardware.

The reducing gas may enter line (14) between regeneration zone (6) and treatment zone (2). The reducing gas may also enter treatment vessel (2) directly, either through the same line that the sulfur-containing compound enters, (12), or a separate line. In either event, it is preferred for the reducing gas to contact the adsorbed sulfur oxides before the sulfur-containing compound contacts the metals-contaminated catalyst. Having the reducing medium enter line (14) upstream of treatment vessel (2) confers the additional advantage of permitting higher partial pressure of the sulfur-containing compound in the treatment vessel.

Unreacted reducing gas and hydrogen sulfide exit treatment vessel (2) at line (15). This hydrogen sulfide may then be removed from the stream in accordance with conventional methods for removing hydrogen sulfide, usually by conversion of the sulfide to sulfur. Preferably, however, the hydrogen sulfide is recycled back to the treatment vessel, which may be accomplished through line 16. Recycling the hydrogen sulfide back to the treatment vessel permits a corresponding reduction in the amount of sulfur-containing compound that must be added to the treatment vessel.

The process permits the regenerated catalyst and sulfur oxide adsorption additive to be recycled back to cracking zone (4) through valve (10), while preventing significant amounts of the reducing gas and hydrogen sulfide present in the treatment vessel (2) from entering the cracking zone (4). The prevention of significant amounts of reducing gas and hydrogen sulfide from entering cracking zone (4) means preventing at least 25% by weight, preferably 50% by weight of the total $H_2S$ and reducing gas produced in the treatment vessel.

The shape and design of the separate treatment vessel (2) should be suitable for contacting an FCC catalyst with a sulfur-containing gas at elevated temperatures and, optionally, the sulfur oxide adsorption additive with the reducing gas.

FIG. 2 shows a suitable treatment vessel design that enables good mixing and high contact times. The catalyst enters the treatment vessel tangentially to the vessel walls through the regenerated catalyst transfer line (30). The exit (31) of transfer line (30) is below the level of catalyst already in the vessel (32). The sulfur-containing compound and, optionally, reducing gas, enter the treatment vessel through line (34), which corresponds to (12) in FIG. 1, and is dispersed in the treatment vessel through grid (36). Effluent gases, which include unreacted sulfur-containing compound, unreacted reducing gas and flue gas, exit through line (38). Some of the effluent gas may be recycled back to the catalyst in the treatment vessel through line (40) or (42). The tangential introduction of the catalyst through line (30) causes the catalyst in the treatment vessel to swirl. The swirling catalyst contacts the hydrogen sulfide and, optionally, reducing gas, distributed through grid (36). The passivated catalyst and sulfur oxide adsorption additive exit through line (44), which leads to the cracking zone.

Another possible design is similar to a spent catalyst stripper as is known in the art. Such a design is shown in FIG. 3. Regenerated catalyst and sulfur oxide adsorption additive enter through the treatment vessel through line (50), where they contact the sulfur-containing gas, which enters through line (52). Line 52 corresponds to lines (12) and (34) in FIGS. 1 and 2, respectively. Good contact is promoted by the internal baffles represented by (54).

The reducing gas may enter line 52 of FIG. 3 along with the sulfur-containing compound, or the reducing gas may enter separately, such as through line 62. Entry of the reducing gas through line 62 is preferred to introduction through line 52, since introduction through line 62 leads to the contact of the adsorbed sulfur oxides with the reducing gas before the catalyst contacts the sulfur-containing compound, which enters through line 52.

The passivated catalyst and regenerated sulfur oxide adsorption additive exit line (56), which leads to the cracking zone. The unreacted sulfur-containing gas and reducing gas as well as other residual gases, such as flue gas, exit effluent line (58) and may be recycled back to the treatment vessel through line (60).

What is claimed is:

1. In a process for reducing sulfur oxide production during an FCC cracking operation, comprising the steps of:

(a) passivating metals contaminating on an FCC catalyst by contacting the FCC catalyst with a sulfur-containing compound under conditions that enable association of the sulfur with the metals contaminants;

(b) cracking hydrocarbons with the passivated FCC catalyst in an FCC cracking zone;

(c) oxidatively regenerating the catalyst in a regeneration zone whereby the carbonaceous material deposited on the FCC catalyst in step (b) is burned off and the sulfur deposited on the FCC catalyst in step (a) is converted to sulfur oxides;

(d) reacting the sulfur oxides with a sulfur oxide adsorption additive capable of adsorbing the sulfur oxides under sulfur oxides adsorbing conditions; and (e) converting the adsorbed sulfur oxides from step (d) to hydrogen sulfide by contacting the adsorbed sulfur oxides with a reducing gas before the regenerated FCC catalyst and sulfur oxides adsorption additive enter the FCC cracking zone;

the improvements comprising contacting the adsorbed sulfur oxides with the reducing gas in a separate treatment vessel and preventing at least 25% by weight, of the hydrogen sulfide from step (e) from entering the cracking zone.

2. The process according to claim 1 wherein the hydrogen sulfide produced in step (e) is cycled to the separate treatment vessel under conditions that cause at least partial passivation of metals on the regenerated catalyst.

3. The process according to claim 1 wherein the sulfur-containing compound is hydrogen sulfide, carbon disulfide, or an organic sulfide.

4. The process according to claim 1 wherein the sulfur-containing compound is hydrogen sulfide.

5. The process according to claim 1 wherein the reducing gas is hydrogen, carbon monoxide, light hydrocarbons, and mixtures thereof.

6. The process according to claim 1 wherein the reducing gas is hydrogen.

7. The process according to claim 1 wherein the reducing gas contacts the adsorbed sulfur oxides before the sulfur-containing compound contacts the catalyst.

8. The process according to claim 7 wherein the reducing gas contacts the adsorbed sulfur oxides upstream from the separate treatment zone.

9. The process according to claim 7 wherein the reducing gas contacts the catalyst in the treatment vessel.

10. The process according to claim 1 wherein the sulfur-containing compound in step (a) comprises hydrogen sulfide from step (e).

* * * * *